US005129114A

United States Patent [19]

Withers

[11] Patent Number: 5,129,114

[45] Date of Patent: Jul. 14, 1992

[54] FOLDING FUTON SUPPORT

[75] Inventor: Randall L. Withers, Little Falls, Minn.

[73] Assignee: Maurice A. Warner, Jr., Bloomington, Minn. ; a part interest

[21] Appl. No.: 767,860

[22] Filed: Sep. 30, 1991

[51] Int. Cl.[5] ..... A47C 17/17

[52] U.S. Cl. ..... 5/47; 5/37.1

[58] Field of Search ..... 5/47, 37.1, 39, 41, 5/48, 17, 18.1

[56] References Cited

U.S. PATENT DOCUMENTS 4,624,823 2/1987 Wiggins ..... 5/47

4,829,611 5/1989 Fireman et al. ..... 5/47

4,996,730 3/1991 Fireman et al. ..... 5/47

FOREIGN PATENT DOCUMENTS 32324 11/1927 France ..... 5/37.1

1359347 3/1964 France ..... 5/39

*Primary Examiner*—Alexander Grosz

*Attorney, Agent, or Firm*—John W. Adams

[57] ABSTRACT

A convertible sofabed particularly designed for use with a futon-type mattress. The sofabed includes a back frame and seat frame elements pivotally connected together and pivotally mounted on a pair of rigid end frame members to facilitate shifting the back frame and the seat frame units from sitting to sleeping position.

4 Claims, 1 Drawing Sheet

Fig1
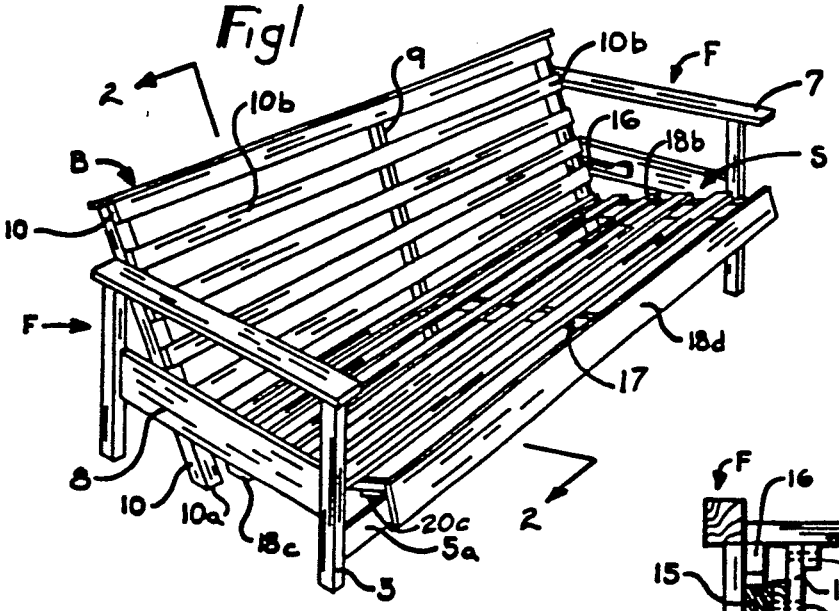
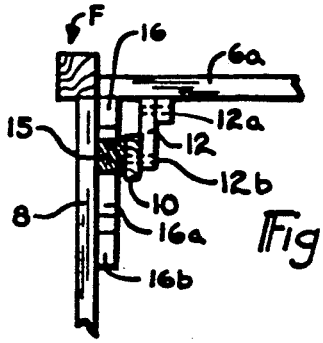
Fig 4
Fig2
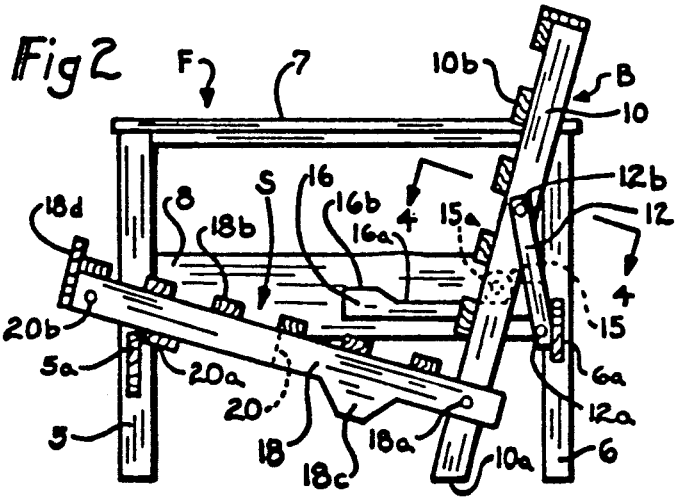
Fig3
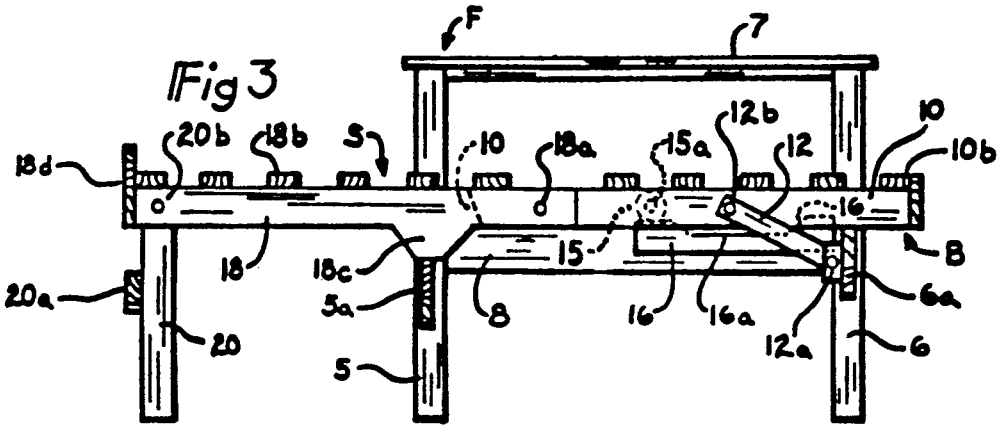

FOLDING FUTON SUPPORT

BACKGROUND OF THE INVENTION

A number of different folding or convertible sofabeds have been designed in the past. These are exemplified in the following U.S. Pat. No. 3,905,053, issued Sep. 16, 1975 to VUCHELICH; U.S. Pat. No. 4,642,823, issued Feb. 17, 1987 to WIGGINS; U.S. Pat. No. 4,829,611, issued May 16, 1989 to FIREMAN; U.S. Pat. No. 4,996,730, issued Mar. 5, 1991 to FIREMAN. All of these prior art references show convertible sofabed constructions. However none shows a convertible sofabed embodying this invention.

SUMMARY OF THE INVENTION

This invention is particularly adapted to provide an extremely durable structurally sound easily convertible sofabed construction particularly designed for use with a unitary futon mattress member. The seat and back units of the sofabed are hinged together and include floor engaging base members for supporting the sofabed when the back is in upright seating position as well as when the unit is extended out into sleeping position. The assembly provides a combined link and roller mechanism which easily moves the back and seat sections from one position to the other while providing rigid floor supporting structure members for the two sections in both positions.

DESCRIPTION OF THE DRAWINGS

FIG. 1 is a perspective view of the supporting frame unit in sofa position;

FIG. 2 is a vertical sectional view of the frame unit in sofa position taken along line 2—2 of FIG. 1; and, FIG. 3 is a vertical sectional view thereof in converted flat sleeping position; and, FIG. 4 is a fragmentary detail view of the link and roller track.

DESCRIPTION OF THE PREFERRED EMBODIMENT

Futons are cushions which have sufficient padding to eliminate the use of springs and are frequently used as a mattress for sleeping on the floor. It is apparent that providing a folding seat arrangement is more convenient and comfortable for use as a bed than having to remove the futon mattress pad from a fixed sofa frame and laying it out on the floor.

The present invention provides a folding seat framework for supporting the futon pad when the same is being used as a seat and then providing a simple yet rigid fold-out flat support for the futon when used as a bed raised above the floor.

The enclosed drawings show a pair of rigid end supporting frames F, each of which is provided with front legs 5 and rear legs 6 and a top supporting arm structure 7 with an intermediate connecting frame member 8. The front legs 5 have a front longitudinal crossbar **5*a* extending therebetween and rigidly fixed thereto. The rear legs 6 also have a rear crossbar 6*a* disposed at a higher elevation than the front crossbar 5*a*** and being rigidly connecting the end frame units F to form a stationary rigid supporting frame assembly.

A back unit B has center frame member 9 and a pair of end frame members 10. All of the frame members 9 and 10 have their lower ends **9*a* and 10*a* respectively supported on the floor when in upright sofa position as shown in FIGS. 1 and 2. A plurality of spaced-apart cross slats 10*b* extend continuously between the two end frame members 10 and across the center frame member 9 of the back unit B which is pivotally connected to the end frames F by pivot links 12. By running the spaced slats 10*b*** from side to side the futon is held against sliding off the sofa unit.

The pivot links 12 pivotally connect the end members 10 of the back unit B with the stationary supporting end frames F as by pivotal connections **12*a* and 12*b*. The links 12 permit the back frame unit B to swing down from inclined sitting position shown in FIG. 2 into horizontal sleeping position shown in FIG. 3. A stabilizing roller 15 is rotatably mounted on the outside of each of the end frame members 10 of the back B and rolls on a track 16*a* formed by a cleat 16 fixed to the inside of each of the end frame members 8**.

A seat frame unit S has a center frame member 17 and a pair of end frame members 18. The rear frame members 9 and 10 are respectively connected to the frame members 17 and 18 by the pivot pins **18*a*. The pivot pins 18*a* are spaced upwardly from the lower ends 10*a* of frame members 9 and 10 which to engage the floor when in retracted sitting position to provide direct support for the seat. A plurality of spaced apart slats 18*b* extend across the seat units between the end frame members 18 and rigidly connect the same. These spaced slats 18*b* run from side to side and combine with the back slats 10*b* to prevent the futon from sliding off the seat unit. A face plate 18*d* extends above the plane defined by the slats 18*b* of the seat to engage the front edge position of the futon and assists the spaced slats in preventing the futon from sliding off the seat section when in use. The front ends of the seat frame members 18 have retractable legs 20 pivotally mounted thereon by pivot pins 20*b*. A cross member 20*a* rigidly interconnects the pivoted legs 20, as best shown in FIG. 3 and extends outwardly beyond both legs 20 to form stop elements 20*c* which engage the lower edges of the end frame members 18 of the seat S when the legs are in retracted position as shown in FIG. 2. The cross member 20*a* engages the top rear edge of the cross bar 5*a*** which extends between the front of the end frame F.

The frame assemblies B and S are shown in retracted sitting position in FIG. 2 wherein the member **20*a* of the leg assembly 20 engages the back edge of the top of the crossbar 5*a* to positively position and anchor the seat and back assemblies S and B in sitting position. The rollers 15 also abut the back ends of the roller track 16*a* to combine with the links 12 and cross member 20*a* to anchor the seat and back assemblies S and B in sitting position. When it is desired to shift the assembly into horizontal sleeping position, as shown in FIG. 3 the front edge of the seat frame assembly S is lifted to raise cross-member 20*a* above the crossbar 5*a* and the seat assembly S is then pulled forwardly. This automatically swings the back unit B down into horizontal position and the rollers 15 move horizontally forwardly on the track 16*a*. The forward end of each cleat 16 has a raised portion 16*b* to raise each roller 15 and elevate the seat back B into flat horizontal alignment with the seat assembly S. This roller and link mechanism makes it very easy to shift the seat and back units from one position to the other and provides a positive positioning of both units in both positions. A pair of elevating support elements 18*c* engage the top edge of the front crossbar 5*a* and are supported thereon, as shown in FIG. 3**, to elevate the intermediate portion of the frame units into horizontal alignment when the units are in sleeping position. This permits the front edge of the seat frame unit to be disposed at a lower elevation for sitting position than for sleeping position. The legs 20 will of course be swung down into vertical position as shown in FIG. 2 to support the front edge of the seat frame unit S when in horizontal sleeping position.

What is claimed is:

1. A convertible sofabed frame assembly comprising a rigid stationary supporting frame structure including end frames with rigid front and rear crossbar elements extending therebetween, a back frame unit pivotally connected to the stationary end frames, a seat frame unit having a pivotal connection at its rear end to the lower portion of the back frame unit and extending forwardly therefrom, the rigid front crossbar of the supporting end frames underlying the front edge portion of the seat frame unit when in sitting position to provide support for the seat frame unit, the forward portion of the seat frame unit being shiftable to facilitate lifting the same and moving the same outwardly to pivot the two frame units from sitting position into horizontal sleeping position, a pair of roller tracks fixed to the inside of the end frames, a pair of rollers journaled on the side portions of the back units for support on the roller tracks during sitting and sleeping positions and also during the shifting of the frame units from one position to the other, a pair of elevating support members extending downwardly from the rear portion of the sides of the seat frame unit to engage the top of the front crossbar of the supporting frame structure to elevate the seat frame unit above its sitting position into horizontal alignment with the back frame unit when said units are in sleeping position.

2. The structure set forth in claim 1 and a pair of link elements respectively connecting the ends of the back frame unit to the respective end frame units to position the back frame unit when said back frame unit is in sitting as well as sleeping position and also during transition from one position to the other.

3. A convertible sofabed frame assembly comprising a rigid stationary supporting frame structure including end frames with rigid front and rear crossbar elements extending therebetween, a back frame unit pivotally connected to the stationary end frames, a seat frame unit having a pivotal connection at its rear end to the lower portion of the back frame unit and extending forwardly therefrom, the rigid front crossbar of the supporting end frames underlying the front edge portion of the seat frame unit when in sitting position to provide support for the seat frame unit, the forward portion of the seat frame unit being shiftable to facilitate lifting the same and moving the same outwardly to pivot the two frame units from seating position into horizontal sleeping position, and a pair of spaced legs pivoted substantially adjacent the forward edge of the seat frame unit to swing down into floor engaging position when the frame units are in flat sleeping position and having a leg cross member connecting the legs to engage the front crossbar of the stationary supporting frame structure and form a stop at the front edge of the seat frame unit when retracted into sitting position, the ends of the leg cross member extending outwardly beyond the legs to engage the bottom side of the seat frame unit when the legs are in folded retracted sitting position to maintain said cross member in abutment position for engaging the rigid front crossbar to anchor the seat frame unit in sitting position, wherein the back frame unit includes a pair of end frame members and the pivotal connection to the seat frame unit being spaced above the lower end of the end frame members to position the ends of said frame members in floor engaging position when the frame units are in sitting position.

4. A convertible sofabed frame assembly comprising a rigid stationary supporting frame structure including end frames with rigid front and rear crossbar members extending therebetween, a back frame unit pivotally connected to the stationary end frames, a seat frame unit having a pivotal connection at its rear end to the lower portion of the back frame unit and extending forwardly therefrom, the rigid front crossbar member of the supporting end frames underlying the front edge portion of the seat frame unit when in sitting position to provide support for the seat frame unit, the forward portion of the seat frame unit being shiftable to facilitate lifting the same and moving the same outwardly to pivot the two frame units from sitting position into horizontal sleeping position, and the back frame unit including a pair of end frame members and at least one intermediate frame member with the pivotal connections between the seat and back units spaced above the lower ends of the end and intermediate frame members a sufficient distance to position the bottom ends of the end and intermediate frame members in floor-engaging stabilizing position when the frame units are in sitting position.

* * * * *